US008263232B2

(12) United States Patent
Kimata et al.

(10) Patent No.: US 8,263,232 B2
(45) Date of Patent: Sep. 11, 2012

(54) COMPOSITE COATED ZINC-CONTAINING PLATED STEEL MATERIAL SUPERIOR IN CORROSION RESISTANCE, BLACKENING RESISTANCE, COATING ADHESION, AND ALKALI RESISTANCE

(75) Inventors: Yoshio Kimata, Tokyo (JP); Atsushi Morishita, Tokyo (JP); Akira Takahashi, Tokyo (JP); Toshikazu Amemiya, Tokyo (JP); Takayuki Kuwagaki, Tokyo (JP); Hidetoshi Shindo, Tokyo (JP); Ikuo Kikuchi, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/226,388

(22) PCT Filed: Apr. 20, 2007

(86) PCT No.: PCT/JP2007/059141

§ 371 (c)(1),
(2), (4) Date: Dec. 19, 2008

(87) PCT Pub. No.: WO2007/123276

PCT Pub. Date: Nov. 1, 2007

(65) Prior Publication Data

US 2009/0202859 A1 Aug. 13, 2009

(30) Foreign Application Priority Data

Apr. 20, 2006 (JP) ..... 2006-116751

(51) Int. Cl.
*B32B 15/04* (2006.01)
*B32B 15/18* (2006.01)

(52) U.S. Cl. ..... 428/624; 428/639; 428/662; 428/679; 428/659; 428/684; 428/219; 428/340

(58) Field of Classification Search ..... 428/615, 428/624, 633, 639, 640, 655, 660, 662, 668, 428/678, 679, 658, 659, 681, 684, 685, 219, 428/340, 704, 702, 689
See application file for complete search history.

(56) References Cited

U.S. PATENT DOCUMENTS

| | | | |
|---|---|---|---|
| 5,468,307 | A | 11/1995 | Schriever |
| 2003/0209293 | A1 | 11/2003 | Sako et al. |

FOREIGN PATENT DOCUMENTS

| | | |
|---|---|---|
| JP | 2000-199077 | 7/2000 |
| JP | 2002-030460 | 1/2002 |
| JP | 2002-332574 | 11/2002 |
| JP | 2004-183015 | 7/2004 |
| JP | 2005-194627 | 7/2005 |
| RU | 2005 125 415 | 2/2006 |
| WO | WO 2004/063414 | 7/2004 |

OTHER PUBLICATIONS

Machine Translation, Tanaka et al., JP 2004-183015, Jul. 2004.*
Machine Translation, Katsumi et al., JP 2002-332574, Nov. 2002.*
International Search Report dated Jul. 3, 2007 issued in corresponding PCT Application No. PCT/JP2007/059141.
Russian Decision of Grant dated Oct. 18, 2010 issued in corresponding Russian Application No. 2008145739/02.
Chinese Office Action dated Apr. 23, 2010 issued in corresponding Chinese Application No. 200780013785.4.
European Search Report in European application No. 07742576.7 dated Apr. 15, 2011.

* cited by examiner

*Primary Examiner* — Michael La Villa
(74) *Attorney, Agent, or Firm* — Kenyon & Kenyon LLP

(57) ABSTRACT

The present invention provides a composite coated zinc-containing plated steel material different from the plated steel materials treated by conventional chromate replacement technologies and superior in all of corrosion resistance, blackening resistance, coating adhesion, and alkali resistance. The composite coated zinc-containing plated steel material of the present invention is characterized by having a composite coating formed by coating and drying on the surface of a plated steel material a treatment solution containing a basic zirconium compound, vanadyl ($VO^{2+}$)-containing compound, phosphoric acid compound, cobalt compound, organic acid, and water and having a pH 7 to 14, the composite coating containing, with respect to the Zr element as 100 parts by mass, V in an amount of 10 to 45 parts by mass, P in 5 to 100 parts by mass, Co in 0.1 to 20 parts by mass, and an organic acid in 10 to 90 parts by mass.

10 Claims, No Drawings

COMPOSITE COATED ZINC-CONTAINING PLATED STEEL MATERIAL SUPERIOR IN CORROSION RESISTANCE, BLACKENING RESISTANCE, COATING ADHESION, AND ALKALI RESISTANCE

TECHNICAL FIELD

The present invention relates to a composite coated plated steel material comprised of a plated steel material used unpainted or painted and given superior corrosion resistance, blackening resistance, coating adhesion, and alkali resistance. More particularly, the present invention relates to a completely chrome-free composite coated zinc-containing plated steel material imparting superior corrosion resistance, blackening resistance, coating adhesion, and alkali resistance to a shaped article made using a zinc-containing plated steel, for example, a shaped article used for a roof, wall, or other building member or a member of an automobile, machine, household electrical appliance, etc., or a sheet coil.

BACKGROUND ART

Zinc-containing plated steel materials and other plated steel materials are being widely used as building materials and members of automobiles, household electrical appliances, etc. due to the high corrosion preventing function of the plating layer metal. However, in plated steel materials, the phenomenon sometimes arises of oxidation due to the salts and other electrolytes contained in the air and the oxygen and moisture present in high temperature, humid environments and consequent formation of white rust and corrosion. Further, in certain environments of a high temperature and humidity, the phenomenon arises of the plated steel material discoloring and appearing to be black. Both these phenomena are due to the deterioration of the plating layer metal and are sometimes considered a problem from the viewpoint of quality and aesthetics when the material is assembled into the above various products.

Further, even when used painted, the penetration of oxygen or moisture sometimes leads to the peeling of the paint film due to the formation or buildup of corrosion products at the plating layer under the paint film. Sometimes a problem is caused in terms of aesthetics and practical use.

Further, sometimes a plated steel material is cleaned by an alkaline degreasing agent after being shaped. In this case, if the material is not durable against alkali, it will discolor or will end up corroding early during use.

As means for preventing such corrosion, blackening, or paint peeling of plated steel materials, in the past the surfaces have been treated by various techniques bringing chrome-containing treatment solutions, such as chromic acid-chromate or phosphoric acid-chromate solutions, into contact with the surfaces of the plated steel materials. By forming what is generally called a "reaction type chromate coating" on the surface of a plated steel material, the above problems are avoided. The chromate coatings obtained by these treatments are mainly comprised of trivalent chrome. While the amount of leaching of the particularly toxic hexavalent chrome is small, the corrosion prevention property cannot be said to be sufficient. In particular, when the damage to a coating due to shaping or scratches reaching the base iron is large, the plated steel material drops in corrosion resistance.

On the other hand, in coating type chromate treatment where a treatment solution containing hexavalent chrome is coated by a roll coater etc. on a material and dried, the coating formed will contain a large amount of hexavalent chrome.

Therefore, even if the chromate coating is damaged due to being worked or scratches etc., the material will have superior corrosion resistance, but sometimes hexavalent chrome will leach out from the chromate coating. Chromate treatment coatings containing hexavalent chrome have a detrimental effect on the human body upon buildup due to their toxicity. As explained above, the coating easily leaches out by nature. Therefore, there can be said to be the problem in terms of environmental protection of the environmental load substances moving outside the system.

In this way, the chromate treatment performed on plated steel materials in the past for the purpose of preventing the formation of white rust is becoming an issue in terms of safety and environmental impact due to the hexavalent chrome. To solve this problem, technology for replacing chromate treatment has been studied.

As a publication describing art replacing chromate by coating a chromate-free treatment solution on the surface of a plated steel material, JP 2002-332574 A may be mentioned. This publication proposes the art of coating a treatment solution containing zirconium carbonate complex ions and vanadyl ions, dimercaptosuccinic acid, etc. and heating it to dry to form a coating of a dense three-dimensional structure and obtain a superior corrosion resistance due to the high ability of adsorption on the surface metal. Further, JP 2002-030460 A describes metal surface treatment agents containing a vanadium compound and a compound containing at least one metal selected from zirconium, titanium, molybdenum, tungsten, manganese, and cerium and metal surface-treated metal materials. Further, JP No. 2004-183015 A describes metal surface treatment agents containing a vanadium compound and a metal compound containing at least one metal selected from cobalt, nickel, zinc, magnesium, aluminum, etc. and metal surface-treated materials.

DISCLOSURE OF THE INVENTION

However, each chromate replacement technology is insufficient in the corrosion resistance, blackening resistance, and coating adhesion. This is the problem to be solved by the present invention.

The inventors engaged in in-depth studies on means for solving the above problem and as a result discovered that by using an aqueous solution of a specific composition to treat a zinc-containing plated steel material, a composite coated zinc-containing plated steel material having superior corrosion resistance, blackening resistance, coating adhesion, and alkali resistance can be obtained and thereby completed the present invention.

That is, the present invention relates to a composite coated zinc-containing plated steel material superior in corrosion resistance, blackening resistance, coating adhesion, and alkali resistance characterized by having a composite coating formed by coating and drying on the surface of a plated steel material a treatment solution containing a basic zirconium compound, vanadyl ($VO^{2+}$)-containing compound, phosphoric acid compound, cobalt compound, organic acid, and water and having a pH 7 to 14, the composite coating containing, with respect to the Zr element as 100 parts by mass, V in an amount of 10 to 45parts by mass, P in 5 to 100 parts by mass, Co in 0.1 to 20 parts by mass, and an organic acid in 10 to 90 parts by mass.

In the present invention, preferably the composite coating has a total coating mass of 50 to 2000 mg/m$^2$. Having a total coating mass of 100 to 1500 mg/m$^2$ is particularly preferable since it improves the corrosion resistance, blackening resistance, coating adhesion, and alkali resistance.

The composite coated zinc-containing plated steel material according to the present invention has extremely superior performance in each of the corrosion resistance, blackening resistance, coating adhesion, and alkali resistance, so the present invention is an invention having extremely great significance industrially.

BEST MODE FOR CARRYING OUT THE INVENTION

The composite coating in the present invention is formed from a pH7 to 14 treatment solution containing a basic zirconium compound, vanadyl ($VO^{2+}$)-containing compound, phosphoric acid compound, cobalt compound, organic acid, and water.

The basic zirconium compound is a source of Zr which supplies the Zr element in the composite coating. The basic zirconium compound is not particularly limited, but for example it may be a zirconium carbonate compound having an anion comprised of $[Zr(CO_3)_2(OH)_2]^{2-}$or $[Zr(CO_3)_3(OH)]^{3-}$or an ammonium salt, potassium salt, sodium salt, etc. containing the anion.

The vanadyl ($VO^{2+}$)-containing compound is a compound supplying the V element in the composite coating. The vanadyl ($VO^{2+}$)-containing compound is not particularly limited, but for example may be a salt between oxovanadium cation and hydrochloric acid, nitric acid, phosphoric acid, sulfuric acid, or other inorganic acid anion or formic acid, acetic acid, propionic acid, butyric acid, oxalic acid, or other organic acid anion. Alternately, a chelate of an organic acid and vanadyl compound, such as vanadyl glycolate, vanadyl dehydroascorbate, may be used.

The composite coating contains the element of V in an amount, with respect to Zr as 100 parts by mass, of 10 to 45 parts by mass. If V is less than 10 parts by mass, the corrosion resistance and the alkali resistance may drop. When V is greater than 45 parts by mass, the blackening resistance and coating adhesion fall. The amount of V in the composite coating is, with respect to Zr as 100 parts by mass, preferably 15 to 30 parts by mass, more preferably 20 to 25 parts by mass.

The phosphoric acid compound is a compound supplying the P element in the composite coating. The phosphoric acid compound is not particularly limited, but may be phosphoric acid and its ammonium salts etc. More specifically, for example, orthophosphoric acid, pyrophosphoric acid, metaphosphoric acid, polyphosphoric acid, phytic acid, phosphonic acid, ammonium phosphate, ammonium dihydrogen phosphate, diammonium hydrogen phosphate, sodium phosphate, potassium phosphate, etc. may be mentioned.

The composite coating contains the element of P in an amount, with respect to Zr as 100 parts by mass, of 5 to 100 parts by mass. If P is less than 5 parts by mass, the corrosion resistance falls, while if greater than 100 parts by mass, the blackening resistance, coating adhesion, and alkali resistance fall. The amount of P in the composite coating is, with respect to Zr as 100 parts by mass, preferably 10 to 70 parts by mass, more preferably 10to 40 parts by mass, particularly preferably 12 to 20 parts by mass.

The cobalt compound is a compound supplying the Co element in the composite coating. The cobalt compound is not particularly limited, but for example may be cobalt carbonate, cobalt nitrate, cobalt sulfate, cobalt acetate, etc.

The composite coating contains the element of Co in an amount, with respect to Zr as 100 parts by mass, of 0.1 to 20 parts by mass. If Co is less than 0.1 parts by mass, the blackening resistance falls, while if Co is greater than 20 parts by mass, the corrosion resistance, alkali resistance, and coating adhesion fall. In particular, as the effect of the cobalt, this is believed to promote the deactivation of the surface of the plated steel material at the time of formation of the coating and serve to protect the material from water, oxygen, and other external factors. The amount of Co in the composite coating is, with respect to Zr as 100 parts by mass, preferably 0.5 to 10 parts by mass, more preferably 0.5 to 5 parts by mass, particularly preferably 0.8 to 1.5 parts by mass.

The composite coating in the present invention also contains an organic acid. The organic acid is not particularly limited, but for example glycolic acid, malic acid, tartaric acid, oxalic acid, citric acid, ascorbic acid, lactic acid, dehydrobenzoic acid, dehydroascorbic acid, gallic acid, tannic acid, and phytic acid may be mentioned. In some cases, ammonium salts of these organic acids may also be used.

The composite coating contains an organic acid in an amount, with respect to Zr as 100 parts by mass, of 10 to 90 parts by mass. When the amount of the organic acid is less than 10 parts by mass with respect to Zr as 100 parts by mass, the corrosion resistance and the coating adhesion end up deteriorating somewhat. Further, when the treatment solution contains only a little organic acid, the storability of the treatment solution ends up falling. In other words, the organic acid forms a complex with the vanadyl ($VO^{2+}$)-containing compound, basic zirconium compound, and phosphoric acid compound and thereby can maintain the stability of the treatment solution (aqueous solution) for forming the composite coating. If the composite coating contains the organic acid in an amount, with respect to Zr as 100 parts by mass, of more than 90 parts by mass, the coating adhesion and the alkali resistance fall. The amount of the organic acid in the composite coating is, with respect to Zr as 100 parts by mass, preferably 10 to 70 parts by mass, more preferably 10 to 50 parts by mass, particularly preferably 15 to 30 parts by mass.

The composite coated zinc-containing plated steel material of the present invention can be produced by coating the surface of a plated steel material with an aqueous solution containing amounts of the basic zirconium compound, vanadyl ($VO^{2+}$)-containing compound, phosphoric acid compound, cobalt compound, and organic acid for supplying the composite coating with the Zr, V, P, and Co elements and organic acid in the above ratios, then heating this to dry and thereby form a coating.

The treatment solution preferably has a pH7 to 14. In this pH range, the basic zirconium compound can be made to stably dissolve in water. As the pH of the treatment solution, 8 to 11 is preferable, while 8 to 10 is particularly preferable. When the pH of the treatment solution has to be adjusted, as the pH adjuster, the substances shown next may be used. For example, ammonia water, triethylamine, triethanolamine, phosphoric acid, nitric acid, hydrofluoric acid, carbonic acid, ammonium fluoride, etc. may be mentioned, but the pH adjuster is not particularly limited so long as it does not remarkably reduce the stability of the treatment solution.

The coating formed becomes a composite coating having a dense three-dimensional structure, superior in barrier property, and improved in corrosion resistance. One reason why such a composite coating is formed is that the organic acid and metal ions become aligned by formation of a complex, a dense three-dimensional structure is formed mainly by Zr—O, V, organic acid, P, and Co become mixed in the clearances (between mesh structures), and zinc etc. introduced due to etching of the plating surface are introduced. Note that in a dense three-dimensional structure using Zr—O, part of the Zr may be substituted by another element. Further, by etching the plating surface by an organic acid when forming the composite coating, the adhesion at the interface of the coating and plating surface is increased and the corrosion resistance and coating adhesion are improved.

The plated steel material on whose surface the composite coating is formed is not particularly limited so long as the plating layer contains zinc. For example, it is possible to use a plated steel material provided with a plating layer comprised of zinc and unavoidable impurities. Alternatively, it is possible to use a plated steel material provided with a plating layer containing, in addition to zinc (and unavoidable impurities), alloy ingredients with zinc, such as Al, Mg, Si, Ti, Ni, and Fe. A particularly preferable plating layer is one containing, in addition to zinc (and unavoidable impurities), one or more of 60 parts by mass or less of Al, 10 parts by mass or less of Mg, and 2 parts by mass or less of Si.

The plating layer of the plated steel material may be formed by any plating method. For example, the plating layer may be formed by any of hot dip plating, electroplating, vapor deposition plating, dispersion plating, vacuum plating, etc. Further, as the hot dip plating method, there are the flux method, Sendzimir method, method of applying Ni or other preplating to secure wettability, etc. Any of these may be used.

Further, for the purpose of changing the appearance after plating, the plated steel material may be sprayed by water or aerated water, sprayed by a sodium phosphate aqueous solution, or sprayed by zinc powder, zinc phosphate powder, magnesium hydrogen phosphate powder, or an aqueous solution thereof.

Further, to further reinforce the blackening resistance of the plating, as pretreatment for applying the composite coating after the plating, the surface may be prepared by a cobalt sulfate or nickel sulfate solution, etc.

The method of coating the plated steel material surface with the treatment solution may be any of the spray method, dipping method, roll coating method, showering method, air knife method, etc. and is not particularly limited.

When coating the treatment solution, to improve the wettability on the surface of the plated steel material, the treatment solution may be given a surfactant, organic solvent, etc. to a range not impairing its inherent performance. Further, if needed, a defoam agent may also be added.

Further, the treatment solution may be given a lubricant or filler, for example, molybdenum disulfide, graphite, tungsten disulfide, boronitride, graphite fluoride, cerium fluoride, melamine cyanurate, fluororesin wax, polyolefin wax, colloidal silica, vapor phase silica, etc. to prevent scratches and wear when working the composite coated zinc-containing plated steel material of the present invention.

The range of the total coating mass of the composite coating of the plated steel material surface is preferably 50 to 2000 $mg/m^2$ or so. In this range, it is possible to obtain the composite coated zinc-containing plated steel material having excellent corrosion resistance, blackening resistance, coating adhesion, and alkali resistance aimed at by the present invention. The particularly preferable range of the total coating amount of the composite coating is 100 to 1500 $mg/m^2$. If less than 100 $mg/m^2$, the corrosion resistance, blackening resistance, and alkali resistance may drop. If over 1500 $mg/m^2$, the coating may become fragile and the alkali resistance and coating adhesion may drop.

When using a treatment solution to treat the plated steel material, the material is preferably heated to dry by a peak metal temperature of 50° C. to 200° C. in range. Note that the heating method is not particularly limited and may be any of hot air, direct flame, induction heating, infrared rays, an electric oven, etc.

EXAMPLES

Next, the present invention will be explained more specifically, but the present invention is not limited to (25 the following specific examples.

Table 1 shows the ratios of the Zr, V, P, Co, and organic acid of the composite coatings prepared. Note that the compounds used for the treatment solutions are indicated by the following notations:

Zr: A1: Zirconium ammonium carbonate
A2: Zirconium sodium carbonate
A3: Zirconium potassium carbonate
V: B1: Vanadyl acetate
B2: Vanadyl phosphate
B3: Vanadyl citrate
B4: Vanadyl propionate
P: C1: Ammonium phosphate
C2: Sodium phosphate
Co: D1: Cobalt carbonate
D2: Cobalt nitrate
Organic acids:
E1: Citric acid
E2: Maleic acid
E3: Ascorbic acid
E4: Adipic acid Note that as comparative conditions, the following prior arts were used.

Prior Art 1:

A composite coating formed from a treatment solution containing Zr, V, and P, not containing Co, and containing dimercaptosuccinic acid.

Prior Art 2:

A composite coating formed from a treatment solution containing Zr and V and not containing P, Co, and an organic acid.

Prior Art 3:

A composite coating formed from a treatment solution containing Zr, V, P, Co, and an organic acid but having ratios of V and organic acid with respect to Zr as 100 parts by mass outside the scope of the present invention (both V and organic acid being greater in amounts).

Prior Art 4:

A coating formed using as a coating type chromate treatment solution a mixed solution of a partially reduced chromic acid aqueous solution (reduction rate 40%) and colloidal silica ($CrO_3$:$SiO_2$=1:3).

The composite coating was prepared by coating a treatment solution diluted by deionized water to adjust the ingredients to predetermined concentrations on the surface of a plated steel material by a roll coater to give a predetermined dried coating amount and immediately using a hot air dryer to heat and dry the coating at a peak metal temperature of 80° C. The treatment solution had a pH of 9.

Table 2 shows the treatment conditions and results of tests and evaluation of the fabricated test pieces. The plated steel materials used have the following notations.

M1: Hot dip Zn plating (plating deposition 90 $g/m^2$)
M2: Hot dip 11% Al-3% Mg-0.2% Si—Zn plating (plating deposition 90 $g/m^2$)
M3: Electro-Zn plating (plating deposition 20 $g/m^2$)
M4: Electro-11% Ni—Zn plating (plating deposition 20 $g/m^2$)
M5: Hot dip 55% Al-1.6% Si—Zn plating (plating deposition 90 $g/m^2$)

Below, the evaluation items and test methods will be shown.

Corrosion Resistance

Sheet and cross-cut test pieces were subjected to salt spray tests based on JIS Z 2371 for 240 hours. The corrosion resistance was judged by the area percentage of white rust after the salt spray test.

The evaluation criteria for the corrosion resistance are as follows:

Sheet test piece:

A: White rust 0%

B: White rust over 0% and not more than 5%

C: White rust over 5% and not more than 30%

D: White rust over 30%

Cross-cut test piece (including white rust at cut parts and vicinities)

A: White rust 0%

B: White rust over 0% and not more than 5%

C: White rust over 5% and not more than 30%

D: White rust over 30%

Alkali Resistance 20 g/L of Parclean® N364S (made by Nihon Parkerizing) was sprayed on the sheet test piece at 60° C. for 30 seconds by a spray pressure of 50 kPa. Thereafter, the test piece was washed by tap water for 10 seconds, then dried by cool air. Next, in the same way as above, this was subjected to a salt spray test for 240 hours and judged for the area percentage of white rust after the salt spray test.

The evaluation criteria for the alkali resistance are shown below:

A: White rust 0%

B: White rust over 0% and not more than 5%

C: White rust over 5% and not more than 30%

D: White rust over 30%

Blackening Resistance

Using a constant temperature and constant humidity test, a test piece was allowed to stand in a 70° C.×RH85% atmosphere for 144 hours, then the appearance was visually examined.

The evaluation criteria for the blackening resistance are shown below:

A: No change at all

B: Almost no change observed

C: Some discoloration observed

D: Clear discoloration observed

Coating Adhesion

A test piece was coated with Amilac 1000 White® (made by Kansai Paint) using a bar coater and was heated to dry at 120° C. for 20 minutes to obtain a 20 μm dried thickness. Next, it was immersed in boiling water for 30 minutes, taken out, then allowed to naturally stand for 24 hours. Thereafter, a cutter knife was used to cut the coating into a checkerboard of 100 1-mm squares and a tape peeling test was used to find the remaining number of coating squares.

The evaluation criteria for the coating adhesion are shown below:

A: Remaining squares 100

B: Remaining squares 98 to less than 100

C: Remaining squares 50 to less than 98

D: Remaining squares less than 50

TABLE 1

Ratios of Ingredients in Composite Coating

Composition of composite coating ("Compound" is a compound used for treatment solution)

| | Zr | | V | | P | | Co | | Organic acid | | | |
|---|---|---|---|---|---|---|---|---|---|---|---|---|
| Composition Coating | Compound | parts by mass | Compound | parts by mass | Compound | parts by mass | Compound | parts by mass | Compound | parts by mass | Other | Remarks |
| Composite Coating 1 | A1 | 100 | B1 | 10 | C1 | 15 | D1 | 1 | E1 | 20 | | Invention |
| Composite Coating 2 | A1 | 100 | B1 | 45 | C1 | 15 | D1 | 1 | E1 | 20 | | Invention |
| Composite Coating 3 | A1 | 100 | B1 | 25 | C1 | 5 | D1 | 1 | E1 | 20 | | Invention |
| Composite Coating 4 | A1 | 100 | B1 | 20 | C1 | 100 | D1 | 1 | E1 | 20 | | Invention |
| Composite Coating 5 | A1 | 100 | B1 | 20 | C1 | 15 | D1 | 0.1 | E1 | 20 | | Invention |
| Composite Coating 6 | A1 | 100 | B1 | 20 | C1 | 15 | D1 | 20 | E1 | 20 | | Invention |
| Composite Coating 7 | A1 | 100 | B1 | 20 | C1 | 15 | D1 | 1 | E1 | 10 | | Invention |
| Composite Coating 8 | A1 | 100 | B1 | 20 | C1 | 15 | D1 | 1 | E1 | 90 | | Invention |
| Composite Coating 9 | A2 | 100 | B1 | 20 | C1 | 15 | D1 | 1 | E1 | 20 | | Invention |
| Composite Coating 10 | A3 | 100 | B1 | 20 | C1 | 15 | D1 | 1 | E1 | 20 | | Invention |
| Composite Coating 11 | A1 | 100 | B2 | 20 | C1 | 15 | D1 | 1 | E1 | 20 | | Invention |
| Composite Coating 12 | A1 | 100 | B3 | 20 | C1 | 15 | D1 | 1 | E1 | 20 | | Invention |
| Composite Coating 13 | A1 | 100 | B4 | 20 | C1 | 15 | D1 | 1 | E1 | 20 | | Invention |
| Composite Coating 14 | A1 | 100 | B1 | 20 | C2 | 15 | D1 | 1 | E1 | 20 | | Invention |
| Composite Coating 15 | A1 | 100 | B1 | 20 | C1 | 15 | D2 | 1 | E1 | 20 | | Invention |
| Composite Coating 16 | A1 | 100 | B1 | 20 | C1 | 15 | D1 | 1 | E2 | 20 | | Invention |
| Composite Coating 17 | A1 | 100 | B1 | 20 | C1 | 15 | D1 | 1 | E3 | 20 | | Invention |

TABLE 1-continued

| Ratios of Ingredients in Composite Coating | | | | | | | | | | | | |
|---|---|---|---|---|---|---|---|---|---|---|---|---|
| Composition of composite coating ("Compound" is a compound used for treatment solution) | | | | | | | | | | | | |
| | Zr | | V | | P | | Co | | Organic acid | | | |
| Composition Coating | Compound | parts by mass | Compound | parts by mass | Compound | parts by mass | Compound | parts by mass | Compound | parts by mass | Other | Remarks |
| Composite Coating 18 | A1 | 100 | B1 | 20 | C1 | 15 | D1 | 1 | E4 | 20 | | Invention |
| Composite Coating 19 | A1 | 100 | B1 | 5 | C1 | 15 | D1 | 1 | E1 | 20 | | Comp. Ex. |
| Composite Coating 20 | A1 | 100 | B1 | 50 | C1 | 15 | D1 | 1 | E1 | 20 | | Comp. Ex. |
| Composite Coating 21 | A1 | 100 | B1 | 20 | C1 | 2.5 | D1 | 1 | E1 | 20 | | Comp. Ex. |
| Composite Coating 22 | A1 | 100 | B1 | 20 | C1 | 150 | D1 | 1 | E1 | 20 | | Comp. Ex. |
| Composite Coating 23 | A1 | 100 | B1 | 20 | C1 | 15 | D1 | 0.05 | E1 | 20 | | Comp. Ex. |
| Composite Coating 24 | A1 | 100 | B1 | 20 | C1 | 15 | D1 | 40 | E1 | 20 | | Comp. Ex. |
| Composite Coating 25 | A1 | 100 | B1 | 20 | C1 | 15 | D1 | 1 | E1 | 5 | | Comp. Ex. |
| Composite Coating 26 | A1 | 100 | B1 | 20 | C1 | 15 | D1 | 1 | E1 | 150 | | Comp. Ex. |
| Prior Art 1 | A1 | 100 | B1 | 50 | C1 | 20 | — | — | E1 | 50 | 0.5 (dimethylcapto-succinic acid) | Comp. Ex. |
| Prior Art 2 | A1 | 100 | B1 | 50 | — | — | — | — | — | — | | Comp. Ex. |
| Prior Art 3 | A1 | 100 | B1 | 100 | C1 | 8 | D1 | 3 | E1 | 100 | | Comp. Ex. |
| Prior Art 4 | Coating type chromate | | | | | | | | | | | Comp. Ex. |

TABLE 2

| Results of Evaluation | | | | | | | | | |
|---|---|---|---|---|---|---|---|---|---|
| | Treatment conditions | | | Corrosion resistance | | Alkali resistance | Blackening resistance | Coating adhesion | |
| | Plated steel mat. | Composite coating | Total coating ($mg/m^2$) | Sheet | Cross-cut | Sheet | | | Remarks |
| Ex. 1 | M1 | Composite Coating 1 | 500 | A | A | A | A | A | Invention |
| Ex. 2 | M1 | Composite Coating 2 | 500 | A | A | A | A | A | Invention |
| Ex. 3 | M1 | Composite Coating 3 | 500 | A | A | A | A | A | Invention |
| Ex. 4 | M1 | Composite Coating 4 | 500 | A | A | A | A | A | Invention |
| Ex. 5 | M1 | Composite Coating 5 | 500 | A | A | A | A | A | Invention |
| Ex. 6 | M1 | Composite Coating 6 | 500 | A | A | A | A | A | Invention |
| Ex. 7 | M1 | Composite Coating 7 | 500 | A | A | A | A | A | Invention |
| Ex. 8 | M1 | Composite Coating 8 | 500 | A | A | A | A | A | Invention |
| Ex. 9 | M1 | Composite Coating 9 | 500 | A | A | A | A | A | Invention |
| Ex. 10 | M1 | Composite Coating 10 | 500 | A | A | A | A | A | Invention |
| Ex. 11 | M1 | Composite Coating 11 | 500 | A | A | A | A | A | Invention |
| Ex. 12 | M1 | Composite Coating 12 | 500 | A | A | A | A | A | Invention |
| Ex. 13 | M1 | Composite Coating 13 | 500 | A | A | A | A | A | Invention |
| Ex. 14 | M1 | Composite Coating 14 | 500 | A | A | A | A | A | Invention |
| Ex. 15 | M1 | Composite Coating 15 | 500 | A | A | A | A | A | Invention |
| Ex. 16 | M1 | Composite Coating 16 | 500 | A | A | A | A | A | Invention |

TABLE 2-continued

| | Results of Evaluation | | | | | | | | |
|---|---|---|---|---|---|---|---|---|---|
| | Treatment conditions | | | Corrosion resistance | | Alkali resistance | Blackening | Coating | |
| | Plated steel mat. | Composite coating | Total coating ($mg/m^2$) | Sheet | Cross-cut | Sheet | resistance | adhesion | Remarks |
| Ex. 17 | M1 | Composite Coating 17 | 500 | A | A | A | A | A | Invention |
| Ex. 18 | M1 | Composite Coating 18 | 500 | A | A | A | A | A | Invention |
| Ex. 19 | M2 | Composite Coating 1 | 500 | A | A | A | A | A | Invention |
| Ex. 20 | M3 | Composite Coating 1 | 500 | A | A | A | A | A | Invention |
| Ex. 21 | M4 | Composite Coating 1 | 500 | A | A | A | A | A | Invention |
| Ex. 22 | M5 | Composite Coating 1 | 500 | A | A | A | A | A | Invention |
| Ex. 23 | M1 | Composite Coating 1 | 50 | B | B | B | B | A | Invention |
| Ex. 24 | M1 | Composite Coating 1 | 100 | A | A | A | A | A | Invention |
| Ex. 25 | M1 | Composite Coating 1 | 1500 | A | A | A | A | A | Invention |
| Ex. 26 | M1 | Composite Coating 1 | 2000 | A | A | B | A | B | Invention |
| Ex. 27 | M2 | Composite Coating 1 | 50 | B | B | B | B | A | Invention |
| Ex. 28 | M2 | Composite Coating 1 | 100 | A | A | A | A | A | Invention |
| Ex. 29 | M2 | Composite Coating 1 | 1500 | A | A | A | A | A | Invention |
| Ex. 30 | M2 | Composite Coating 1 | 2000 | A | A | A | A | B | Invention |
| Comp. Ex. 1 | M1 | Composite Coating 19 | 500 | C | C | C | B | B | Comp. Ex. |
| Comp. Ex. 2 | M1 | Composite Coating 20 | 500 | B | B | B | C | C | Comp. Ex. |
| Comp. Ex. 3 | M1 | Composite Coating 21 | 500 | C | C | B | B | B | Comp. Ex. |
| Comp. Ex. 4 | M1 | Composite Coating 22 | 500 | B | B | D | D | C | Comp. Ex. |
| Comp. Ex. 5 | M1 | Composite Coating 23 | 500 | B | B | B | D | B | Comp. Ex. |
| Comp. Ex. 6 | M1 | Composite Coating 24 | 500 | C | C | C | B | C | Comp. Ex. |
| Comp. Ex. 7 | M1 | Composite Coating 25 | 500 | C | C | C | B | C | Comp. Ex. |
| Comp. Ex. 8 | M1 | Composite Coating 26 | 500 | B | B | D | B | C | Comp. Ex. |
| Comp. Ex. 9 | M2 | Prior Art 1 | 500 | B | B | B | D | C | Comp. Ex. |
| Comp. Ex. 10 | M2 | Prior Art 2 | 500 | C | D | D | D | C | Comp. Ex. |
| Comp. Ex. 11 | M2 | Prior Art 3 | 500 | B | B | D | D | C | Comp. Ex. |
| Comp. Ex. 12 | M1 | Prior Art 4 | 500 | C | C | D | C | B | Comp. Ex. |

As shown in Table 2, the composite coated zinc-containing plated steel material according to the present invention clearly has superior performance in each of the corrosion resistance (evaluation by sheet test piece and cross-cut test piece), blackening resistance, coating adhesion, and alkali resistance. In particular, in test pieces with a composite coating of a total coating mass of 100 to 1500 $mg/m^2$, superior results were exhibited for all of the evaluated corrosion resistance, blackening resistance, coating adhesion, and alkali resistance. As opposed to this, in the plated steel materials of the comparative examples, there were no examples able to satisfy all of the performances of corrosion resistance, blackening resistance, coating adhesion, and alkali resistance.

The invention claimed is:

1. A steel material plated with Zn-containing material and having a composite coating formed thereon, superior in corrosion resistance, blackening resistance, coating adhesion, and alkali resistance characterized by having a composite coating formed by coating and drying on the surface of a plated steel material a treatment solution containing: a zirconium-containing compound comprising (i) a zirconium-containing anion having an anion comprised of $[Zr(CO_3)_2(OH)_2]^{2-}$ or $[Zr(CO_3)_3(OH)]^{3-}$ or (ii) an ammonium salt, potassium salt, sodium salt containing the anion, a vanadyl ($VO^{2+}$)-containing compound, a phosphoric acid compound, a cobalt compound, an organic acid, and water and having a pH of 7 to 14, the composite coating containing, with respect to the Zr element as 100 parts by mass, V in an amount of 10 to 45 parts by mass, P in an amount of 5 to 100 parts by mass, Co in an amount of 0.1 to 20 parts by mass, and the organic acid in an amount of 10 to 90 parts by mass, and wherein an appearance of the plated steel material is not changed after standing in a 70° C. and a relative humidity of 85% atmosphere for 144 hours.

2. The steel material plated with Zn-containing material and having a composite coating formed thereon, superior in corrosion resistance, blackening resistance, coating adhesion, and alkali resistance as set forth in claim 1, characterized in that said composite coating has a total coating mass of 50 to 2000 $mg/m^2$.

3. The steel material plated with Zn-containing material and having a composite coating formed thereon, superior in corrosion resistance, blackening resistance, coating adhesion, and alkali resistance as set forth in claim 2, characterized in that said composite coating has a total coating mass of 100 to 1500 $mg/m^2$.

4. The steel material plated with Zn-containing material and having a composite coating formed thereon, superior in corrosion resistance, blackening resistance, coating adhesion, and alkali resistance as set forth in claim 1 characterized in that the plated steel material has a plating layer comprised of a composition of Zn and unavoidable impurities.

5. The steel material plated with Zn-containing material and having a composite coating formed thereon, superior in corrosion resistance, blackening resistance, coating adhesion, and alkali resistance as set forth in claim 1 characterized in that the plated steel material has a plating layer comprised of a composition containing, in addition to zinc and unavoidable impurities, one or more of 60 parts by mass or less of Al, 10 parts by mass or less of Mg, and 2 parts by mass or less of Si.

6. The steel material plated with Zn-containing material and having a composite coating formed thereon, superior in corrosion resistance, blackening resistance, coating adhesion, and alkali resistance as set forth in claim 1, characterized in that said steel material plated with Zn-containing material has the composite coating in an amount effective in preventing corrosion and blackening in the plated steel material.

7. The steel material plated with Zn-containing material and having a composite coating formed thereon, superior in corrosion resistance, blackening resistance, coating adhesion, and alkali resistance as set forth in claim 1, wherein the vanadyl ($VO^{2+}$)-containing compound is selected from the group consisting of vanadyl acetate, vanadyl phosphate, vanadyl citrate, and vanadyl propionate.

8. The steel material plated with Zn-containing material and having a composite coating formed thereon, superior in corrosion resistance, blackening resistance, coating adhesion, and alkali resistance as set forth in claim 1, wherein the phosphoric acid compound is selected from the group consisting of ammonium phosphate, sodium phosphate, ammonium dihydrogen phosphate, diammonium hydrogen phosphate, and potassium phosphate.

9. The steel material plated with Zn-containing material and having a composite coating formed thereon, superior in corrosion resistance, blackening resistance, coating adhesion, and alkali resistance as set forth in claim 1, wherein the cobalt compound is selected from the group consisting of cobalt carbonate, cobalt sulfate, cobalt acetate, and cobalt nitrate.

10. The steel material plated with Zn-containing material and having a composite coating formed thereon, superior in corrosion resistance, blackening resistance, coating adhesion, and alkali resistance as set forth in claim 1, wherein the organic acid is selected from the group consisting of glycolic acid, tartaric acid, oxalic acid, lactic acid, dehydrobenzoic acid, dehydroascorbic acid, gallic acid, tannic acid, phytic acid, citric acid, maleic acid, ascorbic acid, and adipic acid.

* * * * *